US010196324B2

(12) United States Patent
Deppert et al.

(10) Patent No.: US 10,196,324 B2
(45) Date of Patent: Feb. 5, 2019

(54) FERROCENYL BONDING AGENT OXIDIZERS

(71) Applicant: Raytheon Company, Waltham, MA (US)

(72) Inventors: Thomas M. Deppert, Gilbert, AZ (US); David R. Smith, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 481 days.

(21) Appl. No.: 14/563,348

(22) Filed: Dec. 8, 2014

(65) Prior Publication Data

US 2016/0159708 A1 Jun. 9, 2016

(51) Int. Cl.

| | |
|---|---|
| ***C06B 45/10*** | (2006.01) |
| ***C06B 29/22*** | (2006.01) |
| ***C06B 43/00*** | (2006.01) |
| ***C06B 23/00*** | (2006.01) |

(52) U.S. Cl.

CPC ..... *C06B 45/10* (2013.01); *C06B 23/007* (2013.01); *C06B 29/22* (2013.01); *C06B 43/00* (2013.01)

(58) Field of Classification Search

CPC ..... C06B 45/10; C06B 29/22; C06B 43/00
See application file for complete search history.

(56) References Cited

U.S. PATENT DOCUMENTS

| | | | | |
|---|---|---|---|---|
| 3,301,888 A | | 1/1967 | Cyba | |
| 3,447,981 A | | 6/1969 | Sayles | |
| 3,765,965 A | | 10/1973 | Van Landuyt et al. | |
| 3,789,609 A | * | 2/1974 | Hill | C06B 23/007 149/19.2 |
| 3,962,297 A | * | 6/1976 | Hill | C07F 5/027 149/22 |
| 4,026,912 A | * | 5/1977 | Sayles | C06B 43/00 149/19.9 |
| 4,397,700 A | | 8/1983 | Johnson et al. | |
| 6,039,819 A | | 3/2000 | Harrod et al. | |

FOREIGN PATENT DOCUMENTS

FR 2938837 A1 5/2010

OTHER PUBLICATIONS

Braunschweig H Et al: "Synthesis, structure, and reactivity of borole-functionalized ferrocenes", Chemistry—A European Journal Sep. 10, 2012 Willey-VCH Verlag DEU, vol. 18, No. 37, Sep. 10, 2012, pp. 11732-11746, XP002753427, DOI: 10.1002/Chem.20120137 Figures 1-3, 15 pages.

Eckensberger U D et al: Synthesis and structural characterization of the diborylated organometallics 1, 3-bis (dibromoboryl)-1',2',3',4',5',-(pentamethyl)-ferrocene and Organometallics Feb. 25, 2008 American Chemical Society US, vol. 27, No. 4, Feb. 25, 2008, pp. 764-768, XP002753429, DOI: 10.1021/0M700995Q, Figure 1, 5 pages.

Kaufmann L et al: "Electronic communication in oligonuclear ferrocene complexes with anionic four-coordinate boron bridges", Dalton Transactions 2009 Royal Society of Chemistry; Thomas Graham House; Science Park GB, No. 16, 2009, pp. 2940-2950, XP002753428, DOI: 10.1039/B821406A, Figures 1-3, 11 pages.

Kelly M J Et al: "Synthetic, redbox and coordination chemistry of bis (pentachlorophenyl) boryl ferrocene, FcB (c6C15) 2", Journal of Organometallic Chemistry Oct. 15, 2014 Elsevier NLD, vol. 769, Oct. 15, 2014 pp. 11-16, XP002753426, DOI: 10.1016/J.Jorganchem.2014.07.003, Figures 1-3, 6 pages.

Notification of Transmittal of the International Preliminary Report on Patentability and the Written Opinion of the International Searching Authority, or the Declaration; PCT/US2015/054399; dated Feb. 11, 2016, 7 pages.

Venkatasubbaiah K et al: "Reversible expansion and contraction of a 1,2-diborylated ferrocene dimer promoted by redbox chemistry and nucleophile binding", Angewandte Chemie—International edition Sep. 2, 2005 Wiley-VCH Verlag DE vol. 44, No. 34, Sep. 2, 2005, pp. 5429-5433, XP002753441, DOI: 10.1002/ANIE.200502148, figure 1, 6 pages.

Gore, G. M., et al.; "Evaluation of Ferrocene Derivatives as Burn Rate Modifiers in AP/HTPB-Based Composite Propellants"; Defense Science Journal; vol. 49, No. 2; p. 151-158; Apr. 1999.

Sudhakar, Pagidi, et al.; "Ferrocene-based Lewis Acids and Lewis Pairs: Synthesis and Structural Characterization"; J. Chem. Sci.; vol. 125, No. 1; p. 41-49; Jan. 2013.

Jaekle; Frieder; "Ferrocene-Based Lewis Acids and Frustrated Lewis Pairs"; Project C; retrieved on Dec. 8, 2014 from http://andromeda.rutgers.edu/~fjaekle/research/Jaekle_ResearchC.pdf; p. 1-3; Jun. 2014.

International Search Report and Written Opinion dated Jun. 22, 2017 for Application No. PCT/US2015/054399.

Michael E. Larranaga, et al., "Hawley's Condensed Chemical Dictionary", Published by Wiley, Sixteenth Edition, p. 264, Published in 2016.

R. F. W. Bade, et al., "Properties of Atoms in Molecules: Structures and Reactivities of Boranes and Carboranes", CAN. J. Chem. vol. 70, pp. 657-676, 1992.

* cited by examiner

*Primary Examiner* — Aileen B Felton
(74) *Attorney, Agent, or Firm* — Cantor Colburn LLP

(57) ABSTRACT

Disclosed herein are energetic compositions and methods of making thereof. A composition includes perchlorate or nitrate containing oxidizer particles, a polymeric binder, and a borylated ferrocene derivative bonding agent bonded to a surface of at least a portion the perchlorate or nitrate containing oxidizer particles to form a Lewis complex.

20 Claims, No Drawings

FERROCENYL BONDING AGENT OXIDIZERS

BACKGROUND

The present disclosure relates to energetic compositions, more specifically to bonding agents in perchlorate compositions.

Energetic compositions, for example composite solid rocket propellants and other composite propellants, include solid particles dispersed in a rubbery matrix, called a binder. Solid particles that provide oxidizing chemical species to the combustion process and/or liberate energy upon decomposition are called "oxidizers." Perchlorate containing oxidizers, such as ammonium perchlorate (AP), and nitrate containing oxidizers are used in energetic compositions. The structural properties of the energetic compositions are influenced by the bond strength between the binder and the surfaces of the solid oxidizer particles. Since the solid particles can make up a majority of the particulate matter in the composition, the bond between the binder and the oxidizer particle surfaces has a significant effect on composition's structural properties.

In addition to oxidizer particles and binders, energetic compositions can include bonding agents. Generally, a bonding agent can coat the oxidizer surface, chemically react to form an encapsulating film around the particles, and bond to the binder either chemically or adhesively, for example forming a film. If the bonding agent then has sufficient affinity for the oxidizer surface it can prevent binder-oxidizer particle separation under stress.

The structural properties of energetic compositions derive from a complex interaction of binder properties with the solid oxidizer particles. The composition properties are strongly influenced by the particle size and volumetric loading, as well as by the binder-solids bond strength. When the binder is strong relative to the binder-solids bond strength, a composition under sufficient tension can undergo separation of the binder from the oxidizer particles. The separation is sometimes referred to as de-wetting or blanching and can be followed by large extensions of the binder prior to rupture. Structurally, such a composition can be characterized by high extensibility and low tensile strength. However, when the binder-oxidizer particle bond strength is increased, as by a bonding agent, de-wetting can be prevented or forestalled, resulting in less extensibility and higher tensile strength.

In addition to binders and bonding agents, perchlorate and nitrate containing oxidizer compositions can also include burning rate catalysts, for example iron oxide ($Fe_2O_3$) or copper chromite ($CuCr_2O_4$). Although ferrocene and ferrocene derivatives can dramatically increase the burning rates of AP compositions including such burning rate catalysts, ferrocene and ferrocene derivatives can be problematic because they change concentration over time due to volatility, oxidize during storage, and severely increase friction and impact sensitivity.

SUMMARY

According to one embodiment, a composition includes perchlorate or nitrate containing oxidizer particles, a polymeric binder, and a borylated ferrocene derivative bonding agent bonded to a surface of at least a portion the perchlorate or nitrate containing oxidizer particles to form a Lewis complex.

In another embodiment, a composition includes a contact product of perchlorate or nitrate containing oxidizer particles, a polymeric binder, and a borylated ferrocene derivative bonding agent. The contact product includes a Lewis complex having the following formula: ~B—O~.

Yet, in another embodiment, a method of making a composition includes forming a contact product of perchlorate or nitrate containing oxidizer particles, a polymeric binder, and a borylated ferrocene derivative bonding agent. The borylated ferrocene derivative bonding agent is bonded to a surface of at least a portion the perchlorate or nitrate containing oxidizer particles to form a Lewis complex.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

DETAILED DESCRIPTION

Disclosed herein are energetic compositions and methods of making those compositions. In one embodiment, a composition includes perchlorate or nitrate containing oxidizer particles, a polymeric binder, and a borylated ferrocene derivative bonding agent bonded to a surface of at least a portion the perchlorate or nitrate containing oxidizer particles to form a Lewis complex.

In another embodiment, a composition includes a contact product of perchlorate or nitrate containing oxidizer particles, a polymeric binder, and a borylated ferrocene derivative bonding agent. The contact product includes a Lewis complex having the following formula: ~B—O~.

Yet, in another embodiment, a method of making a composition includes forming a contact product of perchlorate or nitrate containing oxidizer particles, a polymeric binder, and a borylated ferrocene derivative bonding agent. The borylated ferrocene derivative bonding agent is bonded to a surface of at least a portion the perchlorate or nitrate containing oxidizer particles to form a Lewis complex.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

As used herein, the terms "invention" or "present invention" are non-limiting terms and not intended to refer to any single aspect of the particular invention but encompass all possible aspects as described in the specification and the claims.

As used herein, the term "about" modifying the quantity of an ingredient, component, or reactant employed refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like. In one aspect, the term "about" means within 10% of the reported numerical value. In another aspect, the term "about" means within 9, 8, 7, 6, 5, 4, 3, 2, or 1% of the reported numerical value.

As used herein, the terms "percent by weight," "% by weight," and "wt. %" mean the weight of a pure substance divided by the total weight of a compound or composition, multiplied by 100. Typically, "weight" is measured in grams (g). For example, a composition with a total weight of 100 grams, which includes 25 grams of substance A, will include substance A in 25 wt. %.

As used herein, the term "energetic composition" means a mixture including perchlorate containing oxidizer particles or nitrate containing oxidizer particles, a polymeric binder, a bonding agent, and optionally, other additives (e.g., additional fuel or catalytic burning agents). The energetic composition is burned to produce thrust in objects and vehicles, including rockets. Non-limiting examples of energetic compositions include propellants and explosives.

As used herein, the term "perchlorate containing oxidizer" means a salt or compound containing perchlorate ($ClO_4$). As used herein, the term "nitrate containing oxidizer" means a salt or compound containing nitrate ($NO_3$). Perchlorate containing oxidizers and nitrate containing oxidizers are Lewis bases and can therefore chemically bond with a Lewis acid to form a Lewis complex.

As used herein, the term "Lewis acid" means a molecule, compound, monomer, polymer, or copolymer that is an electron-pair acceptor and therefore able to react with an electron donating Lewis base to form a Lewis complex. A Lewis complex is an interaction or chemical bond formed by sharing electrons between a Lewis base and a Lewis acid.

As used herein, the term "fuel" means a substance that burns when combined with oxygen-producing gas for propulsion.

Solid propellants are used extensively in the aerospace industry. For example, solid propellants are a common method of powering missiles and rockets for military, commercial, and space applications. Solid rocket motor propellants are widely used because they are relatively simple to manufacture and use. Further, solid rocket propellants have excellent performance characteristics.

As disclosed herein, energetic compositions, such as propellants and explosives, include perchlorate or nitrate containing oxidizer particles, a polymeric binder, a borylated ferrocene derivative bonding agent, and optionally, a fuel and/or catalytic burning agents. In addition, various plasticizers, curing agents, cure catalysts, and other similar materials which aid in the processing, curing of the propellant, or contribute to mechanical properties of the cured propellant can be added.

The polymeric binder holds or binds the composition together in a coherent form. Hydroxy-terminated polybutadiene (HTPB) is an example of a polymeric binder. When dispersed in a suitable binder, energetic compositions are easier to manufacture and handle, have good performance characteristics, and are economical and reliable.

Energetic compositions must generally meet various mechanical and chemical performance criteria to be considered acceptable for routine use. For example, the composition must have desired mechanical characteristics which allow it to be used in a corresponding rocket or missile. Further, the composition must elastically deform during use to avoid cracking within the propellant grain. If the composition does crack, burning within the crack may be experienced during operation of the rocket or missile. Burning in a confined area can result in an increased surface area of burning propellant or increased burn rate at a particular location. This increase in the burn rate and surface area can directly result in failure of the rocket motor due to over pressurization or burning through of the casing. Accordingly, energetic compositions are typically subjected to standardized stress and strain tests. Data is recorded during such tests and objective measures of stress and strain performance are provided.

To make certain that formulations meet the applicable specifications, bonding agents are employed within the propellant composition. Bonding agents can strengthen the polymeric binder matrix that binds the oxidizer and fuel together. Bonding agents aid in incorporating solid perchlorate or nitrate containing oxidizer particles into the polymeric binder system. Using a bonding agent can improve the stress and strain characteristics of the composition. Thus, bonding agents affect processing, mechanical properties, ballistics, safety, aging, temperature cycling, and insensitive munitions (IM) propellant characteristics. IM refers to requirements for new munitions to be less susceptible to unintended ignition or explosion. IM can be defined by Military Standard MIL-STD-2105D. Bonding agents improve propellant processing, enabling higher solids loading (e.g., up to 88% solids) by wetting the solids, improving stress-strain curves, and eliminating de-wetting (voids and micro porosity) in the propellant.

Accordingly, disclosed herein is a borylated ferrocene derivative that functions as a bonding agent, processing aid, and ballistic modifier in perchlorate and nitrate containing oxidizer formulations. Further, these compounds improve the mechanical properties of the composite propellant. In one aspect, the burning rate of the propellant composition or explosive composition is greater than a like composition without the borylated ferrocene derivative bonding agent. The borylated ferrocene derivative bonding agents function as Lewis acids and therefore accept electrons from the perchlorate or nitrate containing oxidizer (Lewis base) particles to form a stable bond, or a Lewis complex. Thus, the borylated ferrocene derivative bonding agent does not just form a coating on the perchlorate or nitrate containing oxidizer particles. Instead, the bonding agent chemically bonds to at least a portion of the surface of the perchlorate or nitrate containing oxidizer particles. The borylated ferrocene derivative bonding agent can additionally form an encapsulating film or adhesive film around the perchlorate or nitrate containing oxidizer particles. Lewis acid/base chemistry is utilized to provide a borylated ferrocene derivative that is a true bonding agent with perchlorate or nitrate containing oxidizers. The resulting encapsulated oxidizers will have improved wetting properties and become an integral part of the polymeric binder network. After curing, the bonding agent enables the perchlorate or nitrate containing oxidizer particles to then chemically or adhesively bond to the polymeric binder.

The perchlorate containing oxidizer is not intended to be limited and can be any compound or salt that includes perchlorate. Non-limiting examples of suitable perchlorate containing oxidizers include AP, sodium perchlorate, potassium perchlorate, or any combination thereof.

The nitrate containing oxidizer is not intended to be limited and can be any compound or salt that includes nitrate. Non-limiting examples of suitable nitrate containing oxidizers include sodium nitrate, potassium nitrate, ammonium nitrate, or any combination thereof.

Generally, the perchlorate containing oxidizer and nitrate containing oxidizer is in the form of solid particles. The average diameter of the particles can be in a range between about 5 and about 200 microns. The particles can have an average diameter in a range between about 50 and about 100; between 25 and about 125; or between 100 and about 180 microns. In one aspect, the oxidizer particles have an average diameter about or in any range between about 5, 10, 20, 30, 40, 50, 60, 70, 80, 90, 100, 110, 120, 130, 140, 150, 160, 170, 180, 190, 200, 210, 220, 230, 240, and 250 microns.

The perchlorate or nitrate containing oxidizer particles are present in the composition in an amount in a range between about 10 and about 90 wt. %. In other embodiments, the perchlorate or nitrate containing oxidizer particles are present in the composition in an amount about or in any range between about 70 and about 87 wt. %.

The borylated ferrocene derivative bonding agent is a Lewis acid that reacts the perchlorate containing oxidizer or nitrate containing oxidizer particles to form a chemical bond. In one aspect, the borylated ferrocene derivative bonds or reacts with at least a portion of the surface of the particles to form a chemical bond or a Lewis complex. The chemical bond or Lewis complex can be a boron-oxygen bond, which is formed when the boron atom of the borylated ferrocene derivative bonding agent (Lewis acid) accepts electrons from an oxygen atom of the perchlorate or nitrate (Lewis bases). The Lewis complex can have the following formula: ~B—O~. When the borylated ferrocene derivative bonding agent reacts with the perchlorate containing oxidizer, the Lewis complex has the following formula: ~B—$ClO_4$~. When the borylated ferrocene derivative bonding agent reacts with the nitrate containing oxidizer, the Lewis complex has the following formula: ~B—$NO_3$~. Further, the borylated ferrocene derivative bonding agent can chemically bond with the surface of the particles to form an encapsulating film. Then, during subsequent curing of the composition, the borylated ferrocene derivative bonding agent can react with the polymeric binder.

The borylated ferrocene derivative bonding agent can be a monomer, a homopolymer, or a copolymer. The borylated ferrocene derivative can have the following structure:

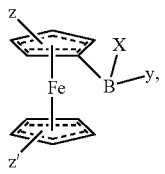

wherein x, y, z, and z' are each independently a hydrogen, an acrylate group, an acyl halide group, an amide group, an amine group, a carboxylate group, a carboxylate thiol group, an ester group, an ether group, a halogen, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a cycloalkyl group, a cycloaryl group, a polycycloaryl group, a substituted cycloaryl group, a metallocene group, a substituted metallocene group, or any combination thereof.

For example, the borylated ferrocene derivative bonding agent can have the following structure:

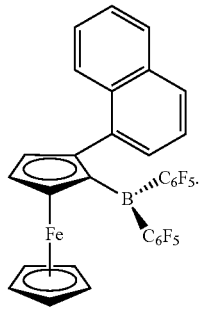

In another non-limiting example, the borylated ferrocene derivative can have the following structure:

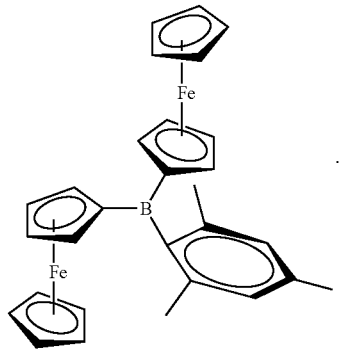

After the borylated ferrocene derivative bonding agent bonds with the perchlorate containing oxidizer particles, the composition can have the following structure:

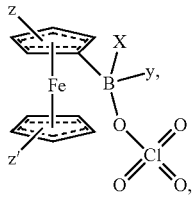

wherein x, y, z, and z' are each independently a hydrogen, an acrylate group, an acyl halide group, an amide group, an amine group, a carboxylate group, a carboxylate thiol group, an ester group, an ether group, a halogen, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a cycloalkyl group, a cycloaryl group, a polycycloaryl group, a substituted cycloaryl group, a metallocene group, a substituted metallocene group, or any combination thereof.

The borylated ferrocene derivative bonding agent can have the following formula:

$R_2B_2R'_2$, wherein R is ferrocenyl or substituted ferrocenyl; and R' is a hydrogen, an acrylate group, an acyl halide group, an amide group, an amine group, a carboxylate group, a carboxylate thiol group, an ester group, an ether group, a halogen, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a cycloalkyl group, a cycloaryl group, a polycycloaryl group, a substituted cycloaryl group, a metallocene group, a substituted metallocene group, or any combination thereof.

For example, the borylated ferrocene derivative can have the following structure:

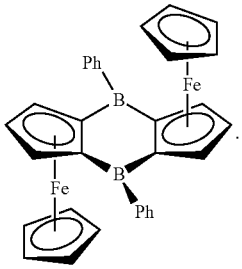

The borylated ferrocene derivative bonding agent can be a polymer having the following formula:

$$(RBR')_n,$$

wherein n is an integer from 1 to 20; R is ferrocenyl or substituted ferrocenyl; and R' is a hydrogen, an acrylate group, an acyl halide group, an amide group, an amine group, a carboxylate group, a carboxylate thiol group, an ester group, an ether group, a halogen, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a cycloalkyl group, a cycloaryl group, a polycycloaryl group, a substituted cycloaryl group, a metallocene group, a substituted metallocene group, or any combination thereof.

For example, the borylated ferrocene derivative bonding agent can be a polymer having the following structure:

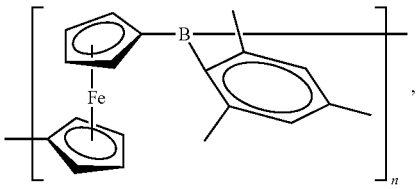

wherein n is an integer from 1 to 20.

In another example, the borylated ferrocene derivative bonding agent can be a polymer having the following structure:

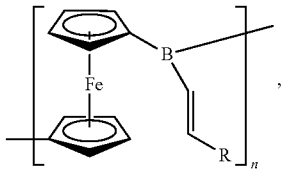

wherein n is an integer from 1 to 20, and R is a hydrogen, an acrylate group, an acyl halide group, an amide group, an amine group, a carboxylate group, a carboxylate thiol group, an ester group, an ether group, a halogen, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a cycloalkyl group, a cycloaryl group, a polycycloaryl group, a substituted cycloaryl group, a metallocene group, a substituted metallocene group, or any combination thereof.

The amount of the borylated ferrocene derivative bonding agent will vary depending on the molar mass of the polymeric binder. The borylated ferrocene derivative bonding agent is present in the composition in an amount in a range between about 0.1 and about 1.0 mol. % based on the polymeric binder. In other embodiments, the bonding agent is present in the composition in an amount about or in any range between about 0.1, 0.2, 0.3, 0.4, 0.5, 0.6, 0.7, 0.8, 0.9, and 1.0 mol. % based on the polymeric binder.

The binder that holds together the components of the solid composition can be, e.g., a polymeric binder (i.e., a material that is polymerized to form solid binder). In other words, the polymeric binder spatially immobilizes particulates of the high-energy material, including fuel material particulates and oxidizer particles.

Non-limiting examples of polymeric binders include polyurethanes or polybutadienes ($(C_4H_6)_n$), e.g., polybutadiene-acrylic acid (PBAA) or polybutadiene-acrylic acid terpolymer (such as polybutadiene-acrylic acid acrylonitrile (PBAN)), and hydroxyl-terminated polybutadiene (HTPB), which can be cross-linked with isophorone diisocyanate, or carboxyl terminated polybutadiene (CTPB). Elastomeric polyesters, polyethers, and glycidyl azide polymers can also be used as binders. The binder is polymerized during manufacture to form the matrix that holds the solid energetic composition components together. The binder also is consumed as fuel when the composite composition is burned, which also contributes to overall thrust. The molecular weight of the polymeric binder can be in a range between about 600 and about 3,000 g/mol.

The polymeric binder is present in the composition in an amount in a range between about 5 and about 90 wt. %. In other embodiments, the polymeric binder is present in the composition in an amount about or in any range between about 13 and about 50 wt. %. In one embodiment, the polymeric binder is present in the composition in an amount about or in any range between about 5, 10, 15, 20, 25, 30, 35, 40, 45, 50, 55, 60, 65, 70, 75, 80, 85, 90, and 95 wt. %.

Optionally, additional fuel can be incorporated into the composition. The optional fuel can be a powder including, but not limited to, at least one suitable metal or alloy. Metals or metal alloys can include aluminum, beryllium, zirconium, titanium, boron, magnesium, and alloys and combinations thereof. The one or more metals can be pure metals. In exemplary embodiments, the powder particles can be micron sized, e.g., have a maximum dimension of 500 μm or less. Nanoscale powders having a maximum dimension of less than about 500 nm, such as less than about 300 nm or about 100 nm, can also be used. Depending on the composition, method of production, and subsequent processing of the metal powder, the metal powder can have various shapes, including spherical, flake, irregular, cylindrical, combinations thereof, or the like. The additional fuel can be present in the composition in an amount in a range between about 2 and about 20 wt. %. In other embodiments, the fuel is present in the composition in an amount about or in any range between about 2 and about 10 wt. %. In one embodiment, the fuel is present in the composition in an amount about or in any range between about 2, 3, 4, 5, 6, 7, 8, 9, 10, 11, 12, 13, 14, 15, 16, 17, 18, 19, and 20 wt. %.

Optional stabilizers and additional processing aids (e.g., burning rate catalysts and curing agents) can be added to the composition. These optional additives can include dibutyltin dilaurate, calcium stearate, carbon black and starch. Non-limiting examples of suitable optional catalysts include iron oxide (e.g., a nanoscale powder), copper chromite, triphenyl bismuth (TPB), or any combination thereof. The additional processing aids are present in the composition in an amount in a range between about 1 and about 10 wt. %. In other embodiments, the processing aids are present in the composition in an amount about or in any range between about 1, 2, 3, 4, 5, 6, 7, 8, 9, and about 10 wt. %.

To make the composition disclosed herein, the perchlorate or nitrate containing oxidizer particles and the borylated ferrocene derivative bonding agent are dissolved and mixed in a suitable solvent. The solvent should be selected based on the dissolution properties of the particular borylated ferrocene derivative being used. Non-limiting examples of suitable solvents include dichloromethane and toluene. Any suitable mixer can be used, for example a mixer with temperature and pressure control.

The perchlorate or nitrate containing oxidizer particles and borylated ferrocene derivative bonding agent are combined in proportions sufficient to create a thin molecular layer of the borylated ferrocene derivative bonding agent on the surface of the oxidizer particles. The perchlorate or nitrate containing oxidizer particles/borylated ferrocene derivative bonding agent combination is then mixed with the polymeric binder. The polymeric binder can be in the form of a liquid, which can be initially mixed with suitable additives, such as plasticizers, antioxidants, stabilizers, or any combination thereof. After combining all components, the pressure of the mixture can be reduced during mixing and then subsequently vented to atmospheric pressure.

The mixture of perchlorate or nitrate containing oxidizer particles, borylated ferrocene derivative bonding agent, and polymeric binder is then cured. Curing converts the mixed material from a viscous fluid to a solid elastomer. Curing can be carried out with any suitable curing agent. One example of a suitable curing agent is a polyisocyanate polymer. During curing, the composition is mixed at temperatures above room temperature.

Non-limiting examples of polyisocyanates include isophorone diisocyanate (IPDI), dimeryl diisocyanate (DDI), methylene diphenyl diisocyanate (MDI), hexamethylene diisocycanate (HDI), or any combination thereof. Other polyisocyanates also can be used. The amount of polyisocyanate generally varies and depends on the structural requirements of the final product, as well as the type of isocyanate, the type and molecular weight of the polymer, and the amount of solids. In one embodiment, the amount of polyisocyanate used is in a range between about 0.5 and about 4 wt. % based on the total weight of the composition.

After adding the curing agent, the composition is then transferred to the desired end item (e.g., rocket motor, sample carton, etc.) and placed in a heated oven until cured. Curing conditions are selected such that modifying temperature, curing time, and component proportions to obtain an optimal product. A non-limiting of suitable conditions are curing times between about 3 and 14 days and temperatures between 30 and 70° C.

When additional fuel additives are included in the composition, the additives are added prior to curing. Generally speaking, also minor proportions, for example up to no more than 2.5 wt. % of substances such as phthalates, stearates, copper or lead salts, carbon black, iron containing species, alumina, rutile, zirconium carbide, stabilizer compounds as applied for energetic compositions (e.g., diphenylamine, 2-nitrodiphenylamine, p-nitromethylaniline, p-nitroethylaniline and centralites) and the like are added to the compositions.

Example

Constructive Example

A method for preparing the inventive composition includes charging a stirred reactor with approximately 1,000 grams of suitable fluid, such as dichloromethane, and approximately 500 grams of the solid perchlorate or nitrate containing oxidizer. The suitable fluid is a suitable solvent for the borylated ferrocene derivative bonding agent, not a solvent for the oxidizer. While stirring at room temperature, approximately 20 grams of the borylated ferrocene derivative bonding agent is added to the mixture. After about 1 hour, the fluid is removed by filtration or evaporation.

Then, a mixture of a liquid polymeric binder, (e.g., hydroxyl terminated polybutadiene (HTPB), glycidyl azide polymer (GAP), or various polyethers and polyesters known in the industry), and optionally, plasticizer, and antioxidant or stabilizer is prepared and mixed in a mixer. While mixing, the borylated ferrocene derivative and perchlorate/nitrate oxidizer mixture is gradually added. After well incorporated into the liquid mixture, the pressure of the mixture is reduced to approximately 15 mm Hg and continued to stir until the power draw of the mixer diminishes and stabilizes. Then, the stirring is stopped, and the mixer is vented to atmospheric pressure.

The mixer is restarted and a polyisocyanate of choice is added (e.g., isophorone diisocyanate (IPDI), dimeryl diisocyanate (DDI), methylene diphenyl diisocyanate (MDI), hexamethylene diisocycanate (HDI), or other various oligomers of HDI known in the industry). While mixing, the pressure is reduced to approximately 15 mm Hg. Then, the stirring is stopped, and the mixer is vented to atmospheric pressure. The composition is transferred to the desired end item (e.g., rocket motor, sample carton, etc.) and placed in a heated oven until cured. The cure times and temperatures can generally vary, although 7 days at 140° F. is representative.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A composition comprising:

perchlorate or nitrate containing oxidizer particles;

a polymeric binder; and a borylated ferrocene derivative bonding agent bonded to a surface of at least a portion the perchlorate or nitrate containing oxidizer particles to form a Lewis complex.

2. The composition of claim 1, wherein the polymeric binder is a hydroxyl terminated polybutadiene, a glycidyl azide polymer, a polyether, a polyester, or any combination thereof.

3. The composition of claim 1, further comprising a burning rate catalyst.

4. The composition of claim 3, wherein the perchlorate containing oxidizer particles is ammonium perchlorate particles.

5. The composition of claim 1, wherein the borylated ferrocene derivative bonding agent has the following structure:

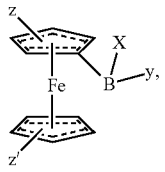

wherein x, y, z, and z' are each independently a hydrogen, an acrylate group, an acyl halide group, an amide group, an amine group, a carboxylate group, a carboxylate thiol group, an ester group, an ether group, a halogen, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a cycloalkyl group, a cycloaryl group, a polycycloaryl group, a substituted cycloaryl group, a metallocene group, a substituted metallocene group, or any combination thereof.

6. The composition of claim 1, wherein the Lewis complex has the following formula: ~B—O~.

7. The composition of claim 1, wherein the composition is a propellant composition or an explosive composition.

8. The composition of claim 1, wherein the borylated ferrocene derivative bonding agent is an encapsulating film around the perchlorate or nitrate containing oxidizer particles.

9. The composition of claim 1, wherein the perchlorate or nitrate containing oxidizer particles are chemically or adhesively bonded to the polymeric binder.

10. The composition of claim 1, wherein the borylated ferrocene derivative bonding agent is a monomer, a homopolymer, or a copolymer.

11. A composition comprising:

a contact product of perchlorate or nitrate containing oxidizer particles, a polymeric binder, and a borylated ferrocene derivative bonding agent;

wherein the contact product includes a Lewis complex having the following formula: ~B—O~.

12. The composition of claim 11, wherein the borylated ferrocene derivative bonding agent has the following formula:

$$(RBR')_n,$$

wherein n is an integer from 1 to 20; R is ferrocenyl or substituted ferrocenyl; and R' is a hydrogen, an acrylate group, an acyl halide group, an amide group, an amine group, a carboxylate group, a carboxylate thiol group, an ester group, an ether group, a halogen, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a cycloalkyl group, a cycloaryl group, a polycycloaryl group, a substituted cycloaryl group, a metallocene group, a substituted metallocene group, or any combination thereof.

13. The composition of claim 11, wherein the borylated ferrocene derivative bonding agent has the following formula:

$$R_2B_2R'_2,$$

wherein R is ferrocenyl or substituted ferrocenyl; and R' is a hydrogen, an acrylate group, an acyl halide group, an amide group, an amine group, a carboxylate group, a carboxylate thiol group, an ester group, an ether group, a halogen, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a cycloalkyl group, a cycloaryl group, a polycycloaryl group, a substituted cycloaryl group, a metallocene group, a substituted metallocene group, or any combination thereof.

14. A method of making a composition, the method comprising:

forming a contact product of perchlorate or nitrate containing oxidizer particles, a polymeric binder, and a borylated ferrocene derivative bonding agent;

wherein the borylated ferrocene derivative bonding agent is bonded to a surface of at least a portion the perchlorate or nitrate containing oxidizer particles to form a Lewis complex.

15. The method of claim 14, wherein the Lewis complex has the following formula: ~B—O~.

16. The method of claim 14, wherein the borylated ferrocene derivative bonding agent has the following structure:

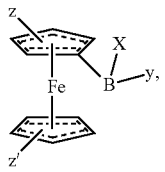

wherein x, y, z, and z' are each independently a hydrogen, an acrylate group, an acyl halide group, an amide group, an amine group, a carboxylate group, a carboxylate thiol group, an ester group, an ether group, a halogen, a hydroxamic acid group, a hydroxyl group, a nitrate group, a nitrile group, a phosphate group, a phosphine group, a phosphonic acid group, a silane group, a sulfate group, a sulfide group, a sulfite group, a thiolate group, an alkane group, an alkene group, an alkyne group, an aryl group, an azide group, an acetal group, an aldehyde group, a diene group, a cycloalkyl group, a cycloaryl group, a polycycloaryl group, a substituted cycloaryl group, a metallocene group, a substituted metallocene group, or any combination thereof.

17. The method of claim 14, wherein the composition is a propellant composition or an explosive composition.

18. The method of claim 14, further comprising a burning rate catalyst.

19. The method of claim 14, wherein the perchlorate or nitrate containing oxidizer particles are chemically or adhesively bonded to the polymeric binder.

20. The composition of claim 1, wherein the borylated ferrocene derivative bonding agent comprises a boron electron pair acceptor that shares electrons with the perchlorate or nitrate oxidizer particles to form a stable bond in the Lewis complex.

* * * * *